United States Patent [19]

Thevenoux

[11] 3,991,577

[45] Nov. 16, 1976

[54] TELESCOPIC SUPPORT CAPS, E.G. FOR USE IN MINING

[75] Inventor: Jean P. Thevenoux, Forbach (Moselle), France

[73] Assignee: Houilleres du Bassin de Lorraine, Freyming-Merlebach, France

[22] Filed: Feb. 13, 1976

[21] Appl. No.: 658,054

[30] Foreign Application Priority Data

Feb. 27, 1975 France ..... 75.06098

[52] U.S. Cl. ..... 61/45 C; 248/357

[51] Int. Cl.[2] ..... E21D 15/14

[58] Field of Search..... 61/45 C, 45 D; 299/11, 299/12, 31, 32, 33; 248/357; 91/170 MP

[56] References Cited

UNITED STATES PATENTS

| | | | |
|---|---|---|---|
| 1,821,020 | 9/1931 | Mensforth | 61/45 C |
| 2,036,490 | 4/1936 | Neilson et al. | 61/45 C |
| 2,371,789 | 3/1945 | Batten | 61/45 C |
| 2,532,168 | 11/1950 | Jakoubek | 61/45 C |
| 3,312,071 | 4/1967 | Dommann | 61/45 D |

FOREIGN PATENTS OR APPLICATIONS

| | | | |
|---|---|---|---|
| 1,291,450 | 3/1962 | France | 61/45 C |

*Primary Examiner*—Dennis L. Taylor
*Attorney, Agent, or Firm*—Cushman, Darby & Cushman

[57] ABSTRACT

This invention concerns a telescopic support cap, e.g. for mining, comprising a main beam element having a support end and an extensible end; a bar slidable relative to, and having one end slidingly connected to, the main element, the other, free end projecting beyond said extensible end; a crank connected at one end by a transverse pivot fixed on the main element at a short distance from the said support end, the other, free end of the crank being shaped for bearing on a timber prop, without other connection; and a hydraulic jack pivoted to the bar and to the crank intermediate the pivotal axis of the latter and its free end, such that the cap is buttressed on actuating the jack by the said free end and by the main element and the crank.

8 Claims, 6 Drawing Figures

1
3
5
14
2
25
26
1
2
25
27

TELESCOPIC SUPPORT CAPS, E.G. FOR USE IN MINING

BACKGROUND OF THE INVENTION

1. Field of the Invention

This invention concerns a support cap of telescopic construction. More particularly, the support cap of telescopic construction, to which the invention relates, has been conceived especially for the exploitation of coal in steep seams by ascending cuts; the applications of the invention are not, however, limited to such use by this fact.

The exploitation of steep seams by ascending cuts or roads requires a support that can be advanced progressively as a cut or road is worked out, starting from the higher level of the packing of the preceding cut.

2. Description of the Prior Art

Some research has been done to adapt modern self-advancing hydraulic supporting means to steep seam working sites. This research has resulted in very heavy and very expensive apparatus the use of which has not spread and is not practical. One such apparatus is described in French Pat. Specification No. 2,087,724. It generally consists of frames formed of beams and a metallic cap. The frames are borne by penetrating into the packing and have to be lifted from one cut or road to the next. This manner of supporting presents many drawbacks as follows: the weight of the apparatus and its high cost, the difficulties in adapting it to irregularities in the surrounding rock and the fact that resistance to vertical forces, resulting from friction of the beams in the packing, is often insufficient or unreliable.

BRIEF SUMMARY OF THE INVENTION

An aim of this invention is to mitigate the above-described drawbacks by the use of a lighter and less expensive material which can conform better to the irregularities in the surroundings and which, finally, bears on beams of discarded wood in the packing, each beam being placed on the beam of the preceding cut, which gives it maximum load-bearing capacity.

This aim is sought to be attained, in a support cap of telescopic construction, by the combination of the following means assembled together:

a main element in the form of a small, straight beam having one end, referred to as the support end, and another end, referred to as the extensible end, a straight bar adapted to slide relative to the main element and having one end slidingly connected to the main element and another, free end projecting outwardly of the main element on the side of the extensible end, a short crank connected to the main element by a pivot with a transverse axle fixed on the main element adjacent the support end at a distance from the latter which is less than the length of the crank, the crank having a free end, opposite to its articulation to the main element, shaped for bearing on a beam, such as a timber prop, without other connecting means, and an extension jack pivotally supported, on the one hand, on a point of the bar and, on the other hand, on a point of the crank intermediate the pivotal axis of the crank on the main element and its free end, in such a manner that the cap can be buttressed on actuating the jack to extend it, by the free end of the bar on the one hand, and by the combination of the main element and the crank, on the other hand.

The invention ensures a true propping between the floor and the roof in the vicinity of the steep seam of coal, and the support of the latter.

Advantageously, the main element and the bar are of U-shaped cross-section and are preferably made of U-shaped sections with outwardly turned flanges.

It is also in accordance with the invention that the free end of the crank should be shaped, e.g. in the form of a cover member, to bear against a one-piece beam such as a timber prop, and expediently the free end of the bar carries means for bearing against the surrounding rock or another one-piece beam.

Surprisingly, by reverting to an old method of supporting by means of separate props and caps, the invention allows the aim put forward to be achieved while preserving the advantages of mechanisation connected with the use of hydraulic means, by virtue of the cap according to the invention constituting a new industrial product.

Other characteristics and advantages will become apparent from the following description, given by way of example only, of the preferred embodiments of the invention, with reference to the accompanying drawings.

DESCRIPTION OF THE PREFERRED EMBODIMENTS

Figure 1:
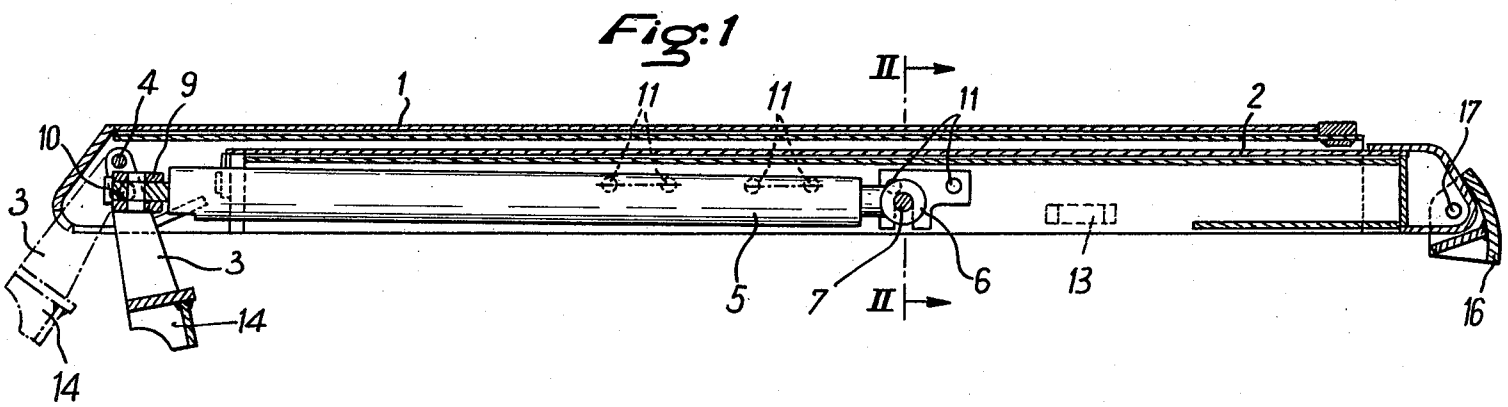
FIG. 1 is a longitudinal section of a cap according to the invention, in a first preferred embodiment.
Figure 2:
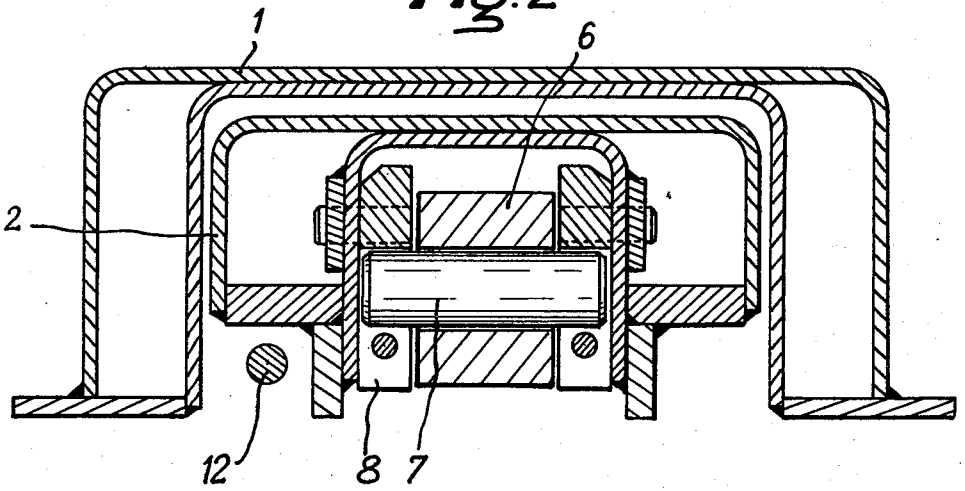
FIG. 2 is a transverse section on an enlarged scale, taken along the plane II—II of FIG. 1.

The cap of telescopic construction shown in FIGS. 1 and 2 consists essentially of a rigid, straight main element 1 constituted by two metallic sheets bent into a U and welded at each of their ends; a straight and rigid bar 2 slidable inside the U of the main element to the right as seen in FIG. 1 and also constituted by two metal sheets bent into a U and made into a U-section box by joining the ends of the two U-shaped members; and a crank 3 of short length articulated about a transverse axle 4 disposed, in the vicinity of the end of the main element 1 that is at the left in FIG. 1, at a distance from this end less than the length of the crank 3. The cap further includes a hydraulic ram or jack 5 that, at its right-hand end as seen in FIG. 1, bears against a fixed stirrup 8 by way of a pivotal connection 6 having an axis 7, the stirrup being carried on the inside of the U-shaped bar 2 and being open to the open side of the U. On the left, the other end of the jack 5 bears by way of a universal joint 9 on a shaft 10 which is carried by the crank 3, is parallel with the axle 4 and is disposed between the latter and the free end of the crank 3.

It is convenient for the fixed stirrup 8 to be removable so as to be securable to a plurality of possible positions along the bar as shown by studs 11 in FIG. 1. In this way, with only a short stroke of the ram one can have a large range of use from the same cap.

To brake the relative movement between the main element and the bar, the latter carries a spindle 12 (FIG. 2) which extends laterally along the whole length of the interior of the U of the bar to which it is fastened at each end by means not shown, such as nuts immobilising it on the end plates. A brake on the sliding movement is constituted by a non-illustrated cut-away plate loosely and transversely guided in a slot 13 traversing one of the double limbs or flanges of the main element. This plate has, in addition to the cut-away portion, a guiding aperture in which the spindle 12 can slide unless a non-illustrated conical wedge comes to pull the plate outwardly, which plate then presses the spindle 12 outwardly to limit the relative movement between the bar 2 and the main element 1.

Figure 3:
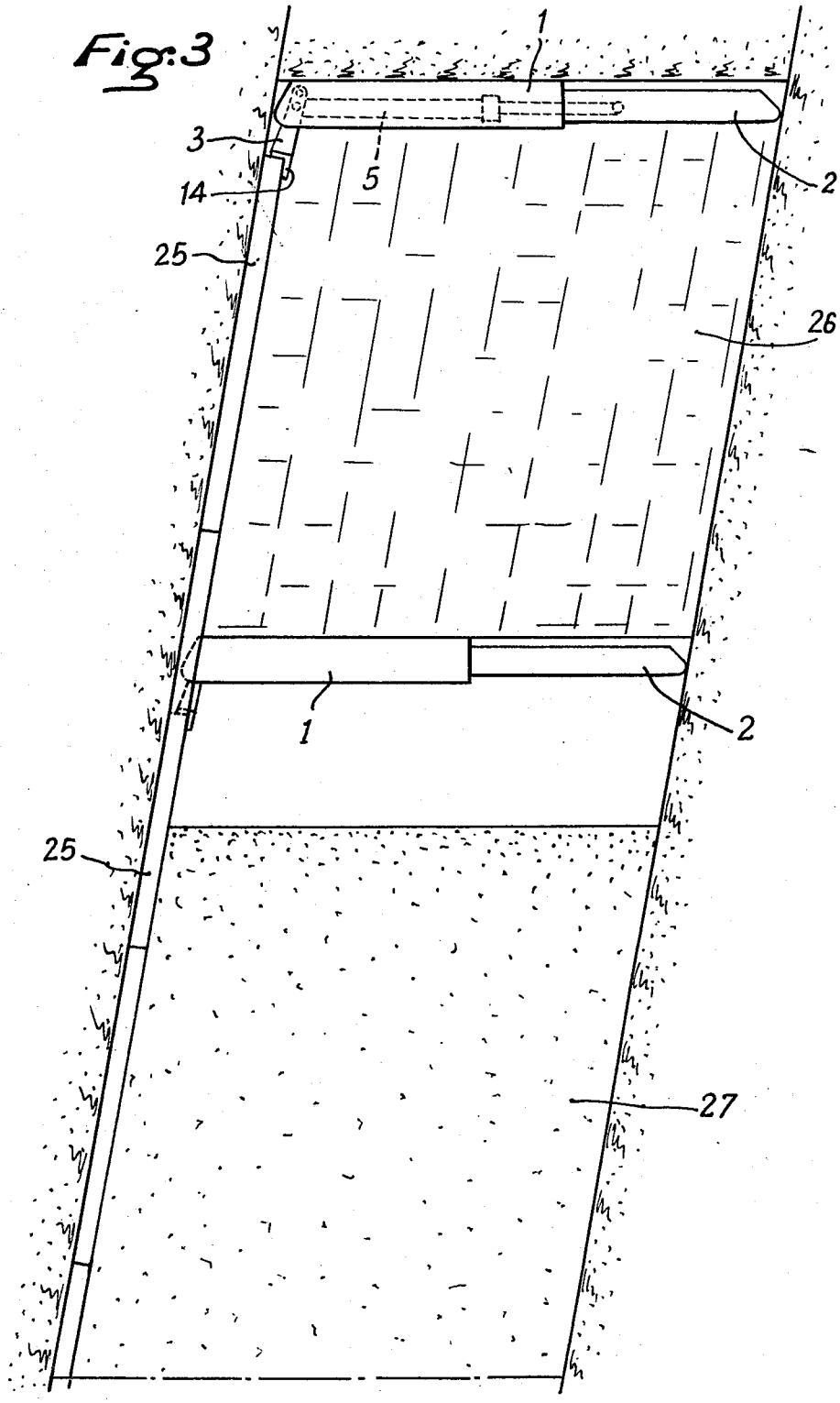
FIG. 3 shows a steep seam of coal in a vertical transverse section exploited by means of ascending horizontal cuts and hydraulic stowing, the support of which utilizes the cap according to the invention.

The free end of the crank 3 is shaped into a cover 14 that can bear on a wooden beam 25, as shown in FIG. 3. The free end of the bar, at the right in FIG. 1, may include a shoe 16 pivoted around a shaft 17.

FIG. 3 shows a method of extraction of a steep seam of coal by means of an ascending cut 26 with hydraulic stowing, wherein the cap according to the invention is utilised. On this Figure, the roof is on the left and the floor is on the right. A cap according to the invention is set, on the roof side, on a wooden beam 25 on which it rests by way of the cover 14 carried by the crank 3.

The crank 3 has a double function; firstly, during the clamping or extension stroke of the jack, it assists in applying the corresponding end of the cap towards the top; secondly, it serves to apply the end of the beam against the roof by bearing against the beam via the cover 14.

FIG. 3 shows the employment of this support in the case where one can make a cut in the crown of coal by liberating an acute angle from the side of the wall. In this case, the cap is buttressed against this wall. Where such buttressing is not possible or is unreliable, one can set the end of the cap on a beam placed on the floor.

The novel method of support thus consists only of a metallic cap associated with one or two wooden beam(s); it is therefore inexpensive and may be abandoned or left in the stowed material 27. As the extraction machine advances in the cut 26, the cap of the previous cut is progressively raised after having added a beam 25 to the top of the previous beam 25 held captive in the stowed material. Progressively, each cap is clamped by temporarily connecting the jack to a line of pressurised hydraulic fluid, such that the bar presses against the floor and the free end of the crank 3, taking up the position shown in chain lines in FIG. 1, presses against the roof at the top of the beam 25.

Figure 4:
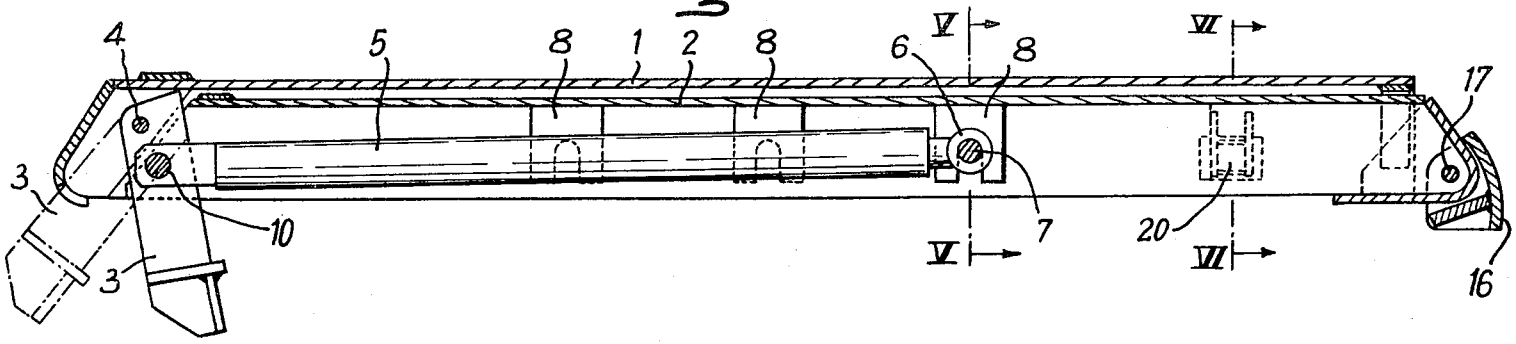
FIG. 4 is a view similar to FIG. 1 but showing another preferred embodiment of the invention.
Figure 5:
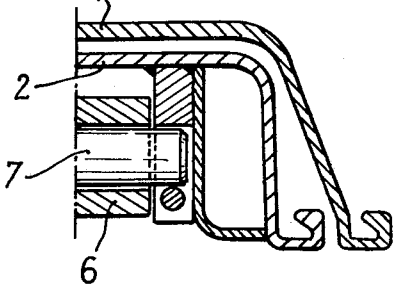
FIGS. 5 and 6 are respective transverse half-sections on an enlarged scale taken along the planes V—V and VI—VI of FIG. 4, respectively.
Figure 6:
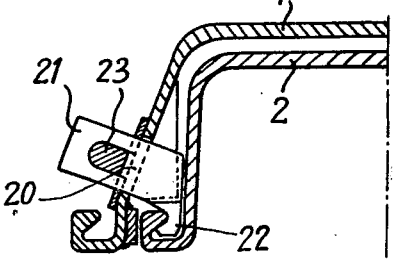

In FIGS. 4, 5 and 6 there is shown a variant of the cap of FIGS. 1 and 2, wherein instead of being constituted by U-shaped metallic sheets formed into a box section by welding, the main element and the bar are constituted by sections like forepoling boards with bent-over flanges. This form of construction is particularly economical because it allows one to start from commercially available sections capable of being adapted for the invention which considerably reduces manufacturing costs.

As the methods of construction, assembly and use of the cap according to FIGS. 4, 5 and 6 are identical to those of FIGS. 1 and 2, except for the profile, the same reference numbers have been used again. Only the method of braking is different. The use of sections with bent-over flanges in fact allows the device to be greatly simplified. The main element has, on at least one side, an aperture 20 into which is inserted a brake constituted by a split lug 21 having a nose 22 shaped complementarily to the configuration of the groove of the bent-over flange on the bar 2. A conical wedge 23 serves as the clamping key of the brake.

I claim as my invention:

1. In a support cap of telescopic construction, the combination of the following means assembled together:

a main element in the form of a generally straight beam having one end, referred to as the support end, and another end, referred to as the extensible end, a straight bar adapted to slide relative to the main element and having one end slidingly connected to the main element and another, free end projecting outwardly of the main element on the side of the extensible end, a crank with two ends, a pivot with a transverse axle connecting one end of the crank to the main element by being fixed thereto adjacent the said support end at a distance from the latter which is less than the length of the crank, the other end of the crank being a free end shaped for bearing on an auxiliary element, such as a timber prop, without other connecting means, and a jack connectable to a source of pressure-fluid and pivotally supported, on the one hand, on a point of the bar and, on the other hand, on a point of the crank intermediate the pivotal axis of the crank on the main element and its free end, the arrangement being such that the cap in use is buttressed on actuating the jack to extend the cap by the free end of the bar on the one hand, and by the combination of the main element and the crank, on the other hand.

2. A cap according to claim 1 wherein a plurality of engagement locations are provided on the bar for engagement with the jack, and releasable connecting means on the jack enable the jack to be connected to the bar at each of said locations.

3. A cap according to claim 1 wherein said main element and said bar are each in the form of interfitting U-sections.

4. A cap according to claim 3 wherein outwardly turned flanges are provided on at least one of said U-sections.

5. A cap according to claim 1 wherein a braking device is provided on the main element for braking the sliding movement of the bar relative to the main element.

6. A cap according to claim 5 wherein said braking device includes a split lug, a nose on the said lug, and a conical wedge; a bent-over flange on said bar defining a groove shaped complementarily to said nose to enable the latter to slide in said groove; a passageway defined in said main element; and the said wedge being effective to pull and clamp the nose across the said passageway.

7. A cap according to claim 1 wherein said free end of the crank is formed into a cover-like shape for engaging said auxiliary member.

8. A cap according to claim 1 wherein a shoe-like bearing member is articulated to the free end of the bar for bearing against the surroundings, in use.

* * * * *